United States Patent [19]

Tanaka et al.

[11] 4,275,806

[45] Jun. 30, 1981

[54] COIN SORTING MACHINE

[75] Inventors: Akio Tanaka; Yoshihisa Nakajima; Shinji Yokomori, all of Kawasaki, Japan

[73] Assignee: Fuji Electric Co., Ltd., Kawasaki, Japan

[21] Appl. No.: 913,161

[22] Filed: Jun. 6, 1978

[30] Foreign Application Priority Data

Jun. 7, 1977 [JP] Japan ..... 52-66971

[51] Int. Cl.[3] ..... G07D 5/08

[52] U.S. Cl. ..... 194/100 A; 133/3 R

[58] Field of Search ..... 194/97 R, 99, 100 R, 194/100 A, 101, 102, 1 K; 73/163; 133/3 R, 3 H

[56] References Cited

U.S. PATENT DOCUMENTS

| | | | |
|---|---|---|---|
| 3,401,780 | 9/1968 | Jullien-Davin | 194/100 R |
| 4,084,677 | 8/1978 | Searle et al. | 194/97 R X |

*Primary Examiner*—F. J. Bartuska

*Attorney, Agent, or Firm*—Sughrue, Rothwell, Mion, Zinn and Macpeak

[57] ABSTRACT

In a coin sorting machine of the type wherein a sorting coil for detecting the characteristics of a coin inserted into the machine is provided along a coin passage and the output signal of the coil is varied to thereby determine whether the inserted coin is true or false when the coin passes by the sorting coil, a coin sorting period is determined by detecting the position of the inserted coin rolling along the coin passage, and the inserted coin is sorted depending on whether or not a predetermined sorting signal is outputted during the coin sorting period.

1 Claim, 6 Drawing Figures

COIN SORTING MACHINE

BACKGROUND OF THE INVENTION

1. Field of the Invention

This invention relates to a coin sorting machine utilized for a vending machine, juke box etc., and more particularly to a coin sorting machine in which a sorting coil for detecting the characteristics of a coin inserted thereinto is provided along a coin passage to utilize the variations of the output signal of the sorting coil caused when a coin passes through the position of the sorting coil in order to identify the coin.

2. Description of the Prior Art

A coin sorting machine is known in the art in which the diameter, thickness and weight of a coin is mechanically detected to determine whether it is a true coin or a false coin. In a coin sorting machine of this type, only the diameter, thickness and weight of a coin are inspected regardless of the material of the coin; that is, if the diameter, thickness and weight of a coin are detected as satisfactory or acceptable, then the coin is determined as a true coin. Accordingly, such a machine is very low in coin sorting accuracy and is, therefore, low in reliability.

In order to overcome the above-described drawbacks, a coin sorting machine has been proposed in the art in which, on the basis of the phenomenon that when a coin is moved past a sorting coil connected to an oscillator the impedance of the coil is changed, the sorting coil is provided along the coin passage and the variation of the impedance of the sorting coil caused when a coin passes through the sorting coil is utilized. Heretofore, the following three coin sorting systems employing such a sorting coil are known in the art. A first one is a system in which a bridge circuit is formed with the sorting coil, a reference impedance element compared with the sorting coil, and two other impedance elements, and the balanced state of the bridge circuit is detected when a coin passes through the sorting coil. A second one is a frequency variation detecting system in which an oscillation circuit is formed with the sorting coil as a resonance element, and the variation of the oscillation frequency of the oscillation circuit is detected when a coin passes through the sorting coil. A third one is an induced voltage detecting system in which the sorting coil is formed with an oscillation coil and a reception coil which are opposed to each other, and the variation of the voltage induced in the reception coil is detected when a coin passes between the two coils. These systems are similar to one another in that the coin sorting operation is effected by determining whether or not a sorting signal based on the output of the sorting coil detecting the material, thickness and diameter of a coin inserted into the machine is within a coin discrimination reference range. One example of such a conventional coin sorting machine, that is, a bridge circuit system will now be described with reference to FIG. 1.

Shown in FIG. 1 is a bridge circuit employed for sorting coins in one monetary denomination. The bridge circuit comprises an oscillator Wo, a sorting coil Lo arranged along a coin passage (not shown), a variable resistor R1, a variable coil L1, and fixed resistors r0 and r1. In the bridge circuit, the values of the variable resistor R1 and the variable coil L1 are so adjusted in advance that when a true coin passes along the sorting coil Lo, the bridge's output V1, that is, the voltage between the connection points c and d is made to be zero by the impedance variation of the sorting coil.

The coin sorting operation of the machine using the bridge circuit described above will now be described. If the inserted coin is a true coin, the balance point of the bridge circuit is detected as shown in FIG. 2 illustrating the waveform of the output between the terminals c and d of the bridge circuit. In FIG. 2, the outut V1 of the bridge circuit is plotted on the vertical axis, while the time t related to the speed of a coin rolling along the coin passage is plotted on the horizontal axis. As is apparent from FIG. 2, at the time instant $t_1$ a coin reaches the position of the sorting coil Lo, as a result of which the impedance of the sorting coil is changed to place the bridge circuit in balanced state. Thus, when a coin passes through the position of the sorting coil Lo, the bridge circuit is balanced only once. This balance point is detected to sort out coins, and it is also utilized as a coin detecting signal. In addition, the system is so designed that even if a coin which is equal in diameter, thickness and weight to a true coin but different in material from the true coin passes through the position of the sorting coil, the bridge circuit is not balanced.

However, when a coin which is equal in material and thickness to the true coin but larger in diameter than the true coin passes through the sorting coil, the bridge circuit is balanced twice as shown in FIG. 3 indicating two balance points. The reason for this phenomenon is that the amount of variation in impedance of the sorting coil Lo caused by the coin larger in diameter is greater than that caused by the true coin. Accordingly, the bridge circuit is balanced once, unbalanced thereafter, and balanced again. More specifically, as the false coin approaches the position of the sorting coil Lo, the impedance thereof is gradually changed. When the impedance is about to reach a value required to balance the bridge circuit, the first balance point e is obtained. Thereafter, the impedance of the sorting coil Lo is further changed, and the bridge circuit is unbalanced. Then, while the false coin is passing through the sorting coil Lo, the impedance of the sorting coil is gradually changed, as a result of which the impedance is about to reach the value required to balance the bridge circuit again, whereupon the second balance point f is obtained. Accordingly, the false coin may be determined as a true coin. Furthermore, the number of coins inserted into the machine may be erroneously counted in the case where the balance point of the bridge circuit is detected twice, and the detection signal is employed as a coin counting signal.

The phenomena described above take place also in the frequency variation detecting system in which the oscillation circuit is formed with the sorting coil as a resonance element, and in the induced voltage detecting system. That is, in these systems also, when a false coin which is made of the same material as that of a true coin but is larger in diameter the true coin passes through the position of the sorting coil, the variation of the oscillation frequency of the voltage in resonance to be detected takes place twice. In these systems, in order to sort the true coin from the false coin, another sorting means is further required, thereby causing the overall mechine to be expensive and the sorting time to be prolonged.

SUMMARY OF THE INVENTION

Accordingly, an object of this invention is to eliminate the above-described drawbacks accompanying a conventional coin sorting machine. More specifically, an object of the invention is to provide a coin sorting machine capable of sorting the true coin from the false coin being larger in diameter than of the true coin, and further capable of extracting a sorting signal only for the true coin.

The foregoing object of the invention has been achieved by the provision of a coin sorting machine in which the coin sorting period utilized for determining whether a coin inserted thereinto is a true coin or a false coin is defined by using detectors adapted to detect the passage of the coin, and when a sorting detection signal is provided only once during the coin sorting period, the coin inserted thereinto is determined as a true coin.

According to this invention, additional sorting means is unnecessary and the coin sorting accuracy can be improved. Furthermore, the inserted coin can be identified as a true coin or false coin substantially simultaneously with the sorting operation of the sorting coil due to the detectors positioned upstream and downstream of the sorting coil in the coin passage.

DETAILED DESCRIPTION OF THE PREFERRED EMBODIMENT

Figure 4:
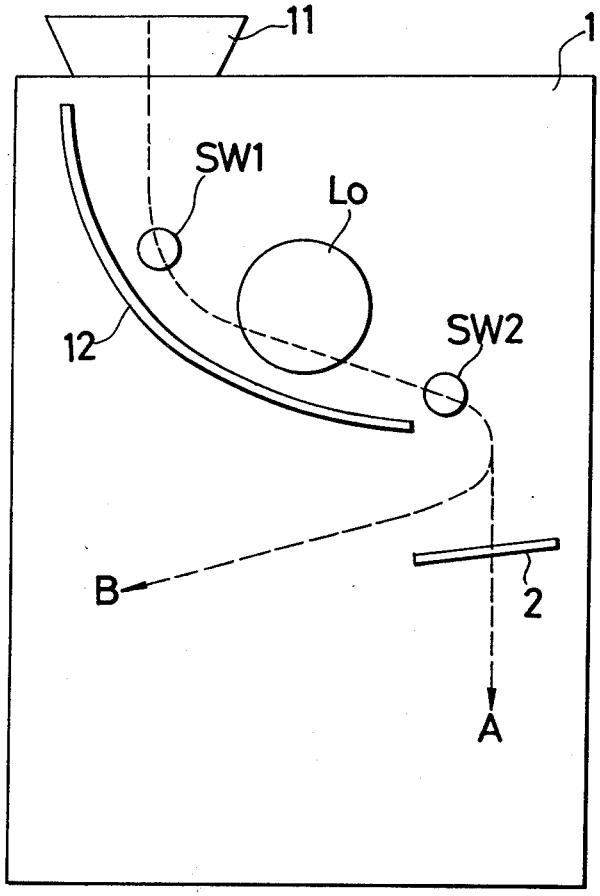
FIG. 4 is a front view showing essential components of a coin sorting machine according to this invention.
Figure 5:
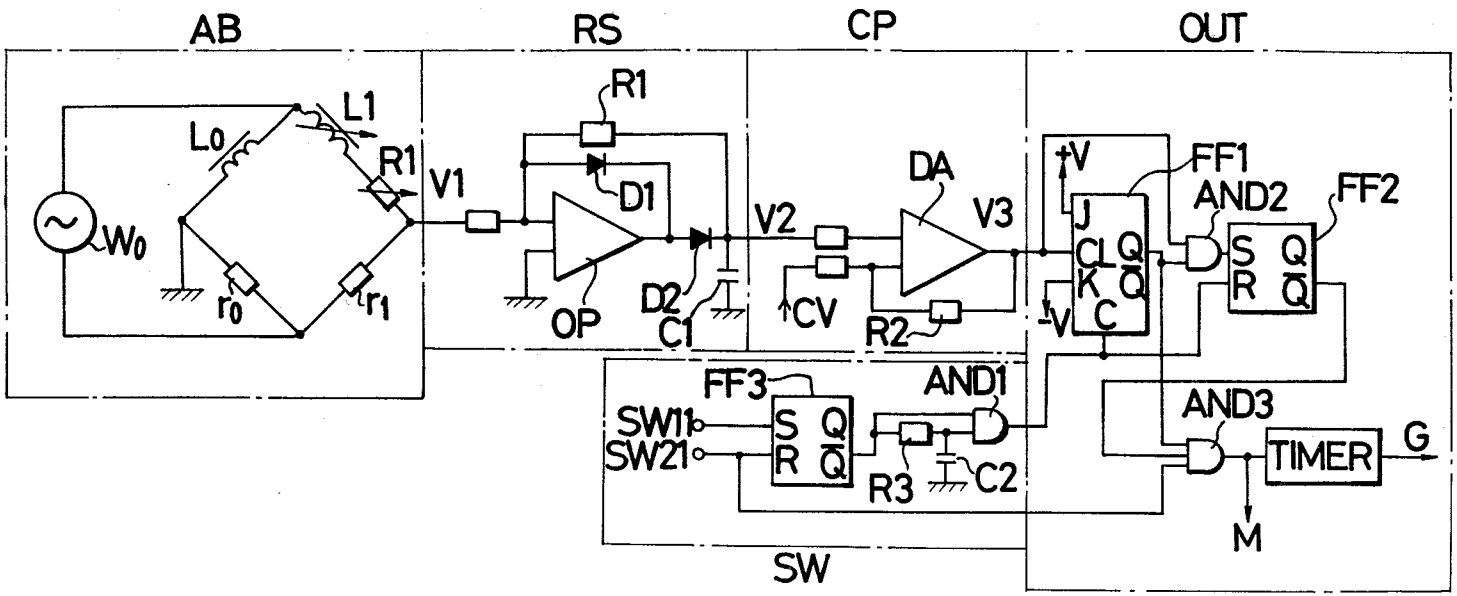
FIG. 5 shows a circuit diagram of a coin sorting circuit employed in the machine according to the invention.

One preferred embodiment of the invention will be described with reference to FIGS. 4 through 6. FIG. 4 is a schematic diagram showing essential components of a coin sorting machine according to the invention. FIG. 5 is a block diagram showing a coin sorting circuit in the machine according to the invention.

Referring to FIG. 4, reference numeral 1 designates a coin sorting machine body having a coin inlet 11 and a protruded piece 12 forming a coin passage, reference character Lo designates a coin selecting coil fixedly provided on a surface confronting a coin rolling along the protruded piece 12 in the passage, reference characters SW1 and SW2 designate detectors which are positioned upstream and downstream of the sorting coil Lo in the coin passage, respectively, and reference numeral 2 designates a sorting member which is provided in the rear side of the sorting machine and disposed so as to be implemented by an electromagnet means (not shown) and is selectively protruded and retracted from the coin passage to direct a coin in the direction of the arrow A (receiving) and in the direction of the arrow B (returning). Each of the detectors SW1 and SW2 comprises a light emission diode or a phototransistor. A coin inserted into the coin inlet 11 is moved along the path indicated by the dotted line. In other words, the coin, rolling along the coin passage, passes through the detector SW1, the sorting coil Lo, and the detector SW2 to reach the gate 2. In this case, if the coin is a true coin, the sorting member 2 is retracted from the coin passage to allow the coin to drop in the direction of the arrow A; but if it is a false coin, the gate 2 is protruded into the coin passage to send it in the direction of the arrow B.

Figure 1:
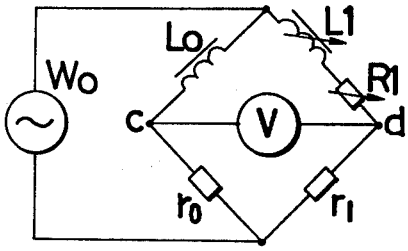
FIG.1 PRIOR ART
FIG. 1 is a circuit diagram showing a conventional coin sorting machine.
Figure 2:
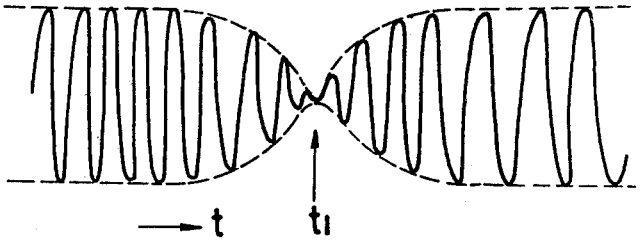
FIG.2 PRIOR ART
FIGS. 2 and 3 are diagrams illustrating the output waveforms of a bridge circuit shown in FIG. 1.
Figure 3:
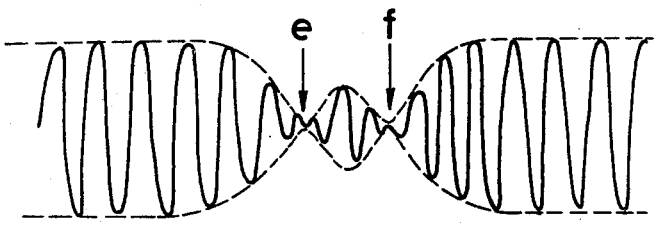
FIG.3 PRIOR ART

The coin sorting circuit, as shown in FIG. 5, comprises: a bridge circuit AB similar to the bridge circuit shown in FIG. 1; a rectifying and smoothing circuit RS having an operational amplifier OP, a feedback resistor R1, diodes D1 and D2 and a smoothing capacitor C1; a comparison circuit CP having a differential amplifier DA, and a feedback resistor R2; a detection output circuit SW comprising an R-S flip-flop FF3, a resistor R3, a capacitor C2 and an AND circuit AND1; and an output circuit OUT having a J-K flip-flop FF1, an R-S flip-flop FF2, AND circuits AND2 and AND3, and a timer T.

In operation, the output V1 of the bridge circuit AB is rectified and smoothed by the rectifying and smoothing circuit RS. The DC output V2 of the circuit RS is compared with a reference voltage CV in the differential amplifier DA of the comparison circuit CP. When the output V2 is lower than the reference voltage CV, that is, the bridge circuit AB is in balance, the comparison circuit CP applies a single pulse, as its output V3, to the clock pulse input terminal CL of the first flip-flop FF1 in the output circuit OUT. On the other hand, in the detecting output circuit SW, a logic signal "1" (hereinafter referred to merely as a signal "1", when applicable) is provided at the terminal $\overline{Q}$ of the third flip-flop FF3 when no set signal is applied to the latter FF3 and, therefore, the AND condition of the AND circuit AND1 is satisfied and signals "1" are applied to the clear input terminal C and reset input terminal R of the first and second flip-flops FF1 and FF2 to reset the latter. Upon application of the detection signal SW11 of the detector SW1 to the set input terminal of the flip-flop FF3, a logic signal "0" is provided at the terminal $\overline{Q}$ thereof and, therefore application of the reset inputs to the flip-flops FF1 and FF2 is released, whereupon a coin sorting period starts. The coin sorting period is ended when the detection signal SW21 of the detector SW2 is applied to the reset input terminal R of the flip-flop FF3. When the flip-flop FF3 is reset, the signal "1" is outputted at the terminal $\overline{Q}$ thereof again, whereby a reset signal is applied through the AND circuit AND 1 to the reset input terminals R of the flip-flops FF1 and FF2. The capacitor C2 connected to one input terminal of the AND circuit AND1 operates in such a manner that, when the signal "1" is provided at the terminal $\overline{Q}$ of the flip-flop FF3, the AND condition of the AND circuit AND 1 is satisfied in a predetermined short delay time (thus, the flip-flops FF1 and FF2 are not reset immediately upon provision of the signal "1" at the terminal $\overline{Q}$ of the flip-flop FF3). When the signal pulse sorting signal V3 is outputted by the comparison circuit CP before the coin is detected by the detector SW2 to determine the coin sorting period, the capacitor C2 operates to cause the flip-flop FF1 or FF2 to positively store the sorting signal V3. On the other hand, in the output circuit OUT, when the sorting signal V3 representative of the balanced state of the bridge circuit is provided only once by the comparison circuit CP during the coin sorting period determined by the detection output circuit SW when the flip-flop FF1 is set and when the detection signal is outputted by the detector SW2, an input signal is applied through the AND circuit AND3 to the timer T. In such a case, a coin counting signal M is outputted through the AND circuit AND3. In the case where the sorting signal V3 representative of the balanced state of the bridge circuit is provided twice or more during the coin sorting period, both of the flip-flops FF1 and FF2 are set, as a result of which the AND condition of the AND circuit AND3 is not satisfied. In this case, no input signal is applied to the timer T and, therefore, the timer T is not operated. Upon application of the input signal, the timer T starts its time limit operation to provide an output in a predetermined period of time, which is utilized as a gate control signal G.

The coin sorting operation of the machine according to the invention will now be described.

Figure 6:
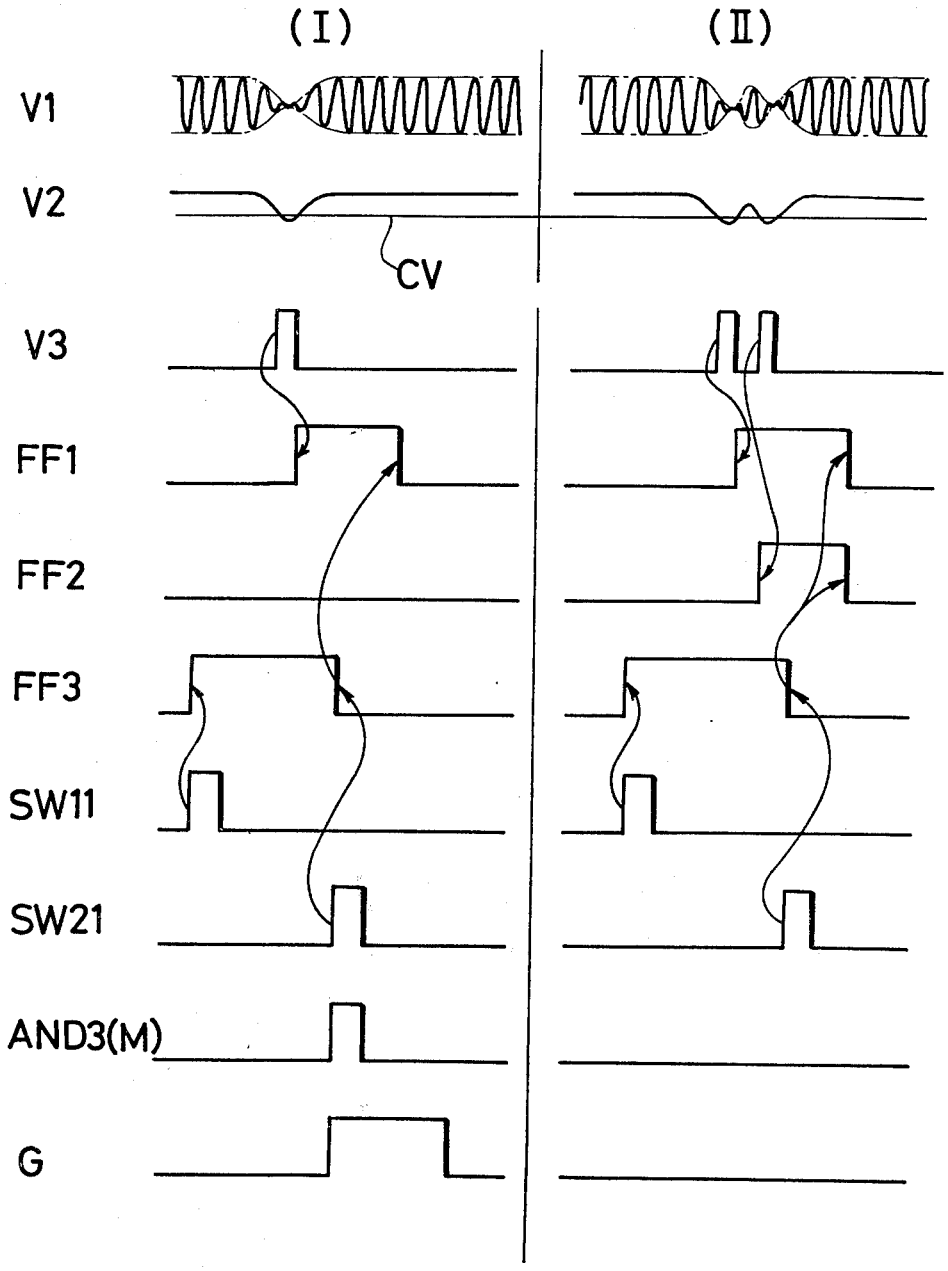
FIG. 6 is a diagram showing waveforms provided at various points in the circuit shown in FIG. 5.

Before a coin is inserted into the coin inlet 11 shown in FIG. 4, the impedance of the sorting coil L0 is varied and the bridge circuit AB is in an unbalanced state, so that the output V1 of the bridge circuit AB is a high unbalanced voltage as indicated by V1 in FIG. 6. The parts (I) and (II) of FIG. 6 show waveforms in the case of a true coin and in the case of a false coin, respectively. Before a coin is inserted into the coin inlet, it goes without saying that no coin is detected by the detectors SW1 and SW2. Therefore, the flip-flop FF3 is in a reset state and, accordingly, the flip-flops FF1 and FF3 are also in a reset state through the AND circuit AND1. If, while the flip-flops FF1, FF2 and FF3 are in reset state, a coin is inserted into the coin inlet 11, the coin is first detected by the detector SW1, as a result of which the detection signal indicated by SW11 in the part (I) of FIG. 6 is outputted by the detector SW1. Upon application of this detection signal SW11, the flip-flop FF3 (which employs the signal SW11 as its set input signal) is set as indicated by FF3 in the part (I) of FIG. 6. As a result, the signal "0" is provided at the terminal $\overline{Q}$ of the flip-flop FF3, and the AND condition of the AND circuit AND1 is not satisfied, so that the AND circuit AND1 provides "0" as its output. When the AND circuit AND1 provides the output "0", application of the reset input signals to the flip-flops FF1 and FF2 is released, whereby the coin sorting period is started. The signal "1" is applied to one input terminal of the AND circuit AD3 from the terminal $\overline{Q}$ of the flip-flop FF2.

The coin detected by the detector SW1 is allowed to pass through the position of the sorting soil Lo, whereupon the impedance of the sorting coil is changed to bring the bridge circuit into the balanced state. The output V1 of the bridge circuit AB is rectified and smoothed into a positive DC output V2, as indicated by V2 in the part (I) of FIG. 6, by the rectifying and smoothing circuit RS. The output V2 is compared with the reference voltage CV in the comparison circuit CP. The reference voltage is indicated together with the output V2 in FIG. 6. The magnitude of the output V1 of the bridge circuit AB approaches zero as the state of the bridge circuit is changed from unbalanced to balanced. Therefore, when the bridge circuit AB is in the balanced state, the output V2 of the rectifying and smoothing circuit RS becomes lower than the reference voltage CV. When the output V2 becomes lower than the reference voltage CV as described above, the comparison circuit outputs a sorting signal V3 of a single pulse, as indicated by V3 in the part (I) of FIG. 6, while the output V2 is lower than the reference voltage CV. The sorting signal V3 of the comparison circuit CP is applied to the set input terminal CL of the flip-flop FF1 in the output circuit OUT. In this case, as application of the reset input signal to the flip-flop FF1 has been released, the flip-flop FF1 is set by the application of the sorting signal V3, as indicated by FF1 in the part (I) of FIG. 6. When the flip-flop FF1 is set, the signal "1" is applied to one of the input terminals of the AND circuit AND3 which is connected to the terminal Q of the flip-flop FF1.

Passing through the position of the sorting coil Lo, the coin reaches the detector Sw2. The detection signal SW21 of the detector SW2 is as indicated by SW21 in the part (I) of FIG. 6. By this detection signal SW21, the flip-flop FF3 is reset, and the AND condition of the AND circuit AND3 is satisfied. As a result, the coin counting signal M is outputted, and the timer T is operated to output the gate signal G in the predetermined limit time. The gate member 2 shown in FIG. 4 is retracted from the coin passage by the gate signal M, to thereby lead the coin in the direction of the arrow A. When the flip-flop FF3 is reset by the aforementioned detection signal SW21, the signal "1" is provided at its terminal $\overline{Q}$. Therefore, the AND condition of the AND circuit AND1 is satisfied in the short delay time with the aid of the capacitor C2, and the AND circuit AND1 outputs the signal "1" to reset the flip-flops FF1 and FF2. When the flip-flops FF1 and FF2 are reset, the coin sorting period is ended and, therefore, the machine is placed in the standby state to be ready for the next coin insertion.

Now, the case where a false coin which is made of the same material as that of a true coin but is larger in diameter than the true coin, will be described. The waveforms provided at various points in the coin sorting circuit in this case are as indicated in the part (II) of FIG. 6. When the false coin is inserted into the coin inlet 11 shown in FIG. 4, the coin is first detected by the detector SW1, the detection signal SW11 of which sets the flip-flop FF3. Accordingly, the signal "0" is provided at the terminal $\overline{Q}$ of the flip-flop FF3, and is applied by the AND circuit AND1 to the flip-flops FF2 and FF1 to release the reset states of the latter. The coin passed through the detector SW1 is then brought to the position of the sorting coil Lo. When the inserted coin reaches the position of the sorting coil Lo and when it passes through the position of the sorting coil Lo, the bridge circuit is brought into balance as indicated by V1 in the part (II) of FIG. 6. The output V1 of the bridge circuit AB is converted into a single pulse sorting signal V3 representative of the balanced state of the bridge circuit by means of the rectifying and smoothing circuit RS and the comparison circuit CP. When the first single pulse, or the sorting signal V3 of the comparison circuit CP, is applied to the flip-flop FF1, the signal "1" is provided at the terminal Q thereof, that is, the signal "1" is applied to one input terminal of the AND circuit AND2 and to one input terminal of the AND circuit AND3. When the second single pulse is outputted by the comparison circuit CP after the flip-flop FF1 has been set by the first single pulse, the signal "1" is applied to the other input terminal of the AND circuit AND2. Thus, the AND condition of the AND circuit AD2 is satisfied, and the set input signal "1" is applied to the flip-flop FF2. As a result, the signal "0" is provided at the terminal $\overline{Q}$ of the flip-flop FF2 and, therefore, the signal "0" is applied to another input terminal of the AND circuit AND3.

When the coin passed through the position of the sorting coil Lo reaches the next detector SW2, the letection signal SW21 is outputted by the detector SW2, as a result of which the flip-flop FF3 is reset. In his case, the detection signal SW21 is applied also to he AND circuit AND3. However, the AND condition of the AND circuit AD3 is not satisfied, because one nput terminal of the AND circuit AND3 is connected o the terminal $\overline{Q}$ of the flip-flop FF2 which is in the set tate. Accordingly, neither of the coin counting signal M and the gate signal G are outputted, and the gate nember 2 is maintained protruded into the coin passage o prevent the coin from dropping in the direction of the rrow A and to lead it in the direction of the arrow B. When the flip-flop FF3 is reset by the aforementioned letection signal SW21, the signal "1" is outputted at its erminal $\overline{Q}$, and is applied through the AND circuit AND1 to the flip-flops FF1 and FF2 to reset the latter. When the flip-flops FF1 and FF2 are thus reset, the coin orting period is finished and the machine is brought nto the standby state to be ready for the next coin nsertion.

In the above-described coin sorting machine, a bridge ircuit whose one side is the sorting coil is employed. However, it should be noted that the technical concept of the invention can be applied to a coin sorting mahine in which an oscillator is made up of the sorting oil so that the oscillation frequency variation caused when a coin is passed therethrough is detected, or to a oin sorting machine in which a sorting coil is made up of an oscillation coil and a reception coil so that the variation of voltage induced in the reception coil when coin passes therethrough is detected.

In the case where an inserted coin is sorted out only on the basis of the balance point of the bridge circuit, it is impossible for a conventional machine to reject a false oin which is equal in material and thickness to a true oin but larger in diameter than the true coin and, acordingly, the machine needs an additional bridge circuit and must be operated in combination with another oin sorting method. On the other hand, as is apparent rom the above description, the machine according to he invention can sort out coins with only one bridge ircuit without decreasing its sorting performance and, herefore, it is economical. When a coin reaches the etector which is provided downstream of the sorting oil but upstream of the gate member in the coin moving direction, the gate member is controlled. Therefore, he gate member is always controlled at a predetermined time instant. Furthermore, as the gate member is ontrolled after the rolling operation of each coin is confirmed, distribution of the inserted coins can be correctly carried out.

What is claimed is:

1. A coin sorting machine in which a sorting coil for detecting the characteristics of a coin inserted into the machine is provided along a coin passageway provided therein, said coil producing a true sorting signal when the inserted coin is a true coin and not a false coin, but, in which, when a false coin is of the same material and thickness as, but of a diameter larger than, a true coin is detected, said coil produces two closely spaced true sorting signals, wherein the improvement comprises:

first and second coin detecting means located upstream and downstream, respectively, of said sorting coil for producing first and second coin detecting signals when an inserted coin is detected by said first and second coin detecting means, respectively;

said first and second coin detecting signals defining a sorting period during which a true coin sorting signal must occur in order to recognize a coin as a true coin;

first circuit means responsive to the occurrence of only one of said sorting signals during said sorting period for generating a true coin output signal;

second circuit means responsive to the occurrence of both of said sorting signals during said sorting period for inhibiting said first circuit means and thereby preventing the generation of said true coin output signal, whereby said false coin of said larger diameter is not recognized as a true coin;

a first flip-flop which receives a first sorting signal as a set input signal to produce a first output signal;

a second flip-flop which, when said first flip-flop is in set state, is set by a second sorting signal to produce a second output signal;

a third flip-flop which receives as a set input signal said first detection signal and receives as a reset input signal said second detection signal and applies a reset input signal to said first and second flip-flops when said third flip-flop is in a reset state; and means for receiving the first and second output signals of said first and second flip-flops, respectively, and providing a true coin output signal indicating that said inserted coin is a true coin only when only said first and third flip-flops have been set during said coin sorting period.

* * * * *